US005890461A

United States Patent [19]

Iikura

[11] Patent Number: 5,890,461

[45] Date of Patent: Apr. 6, 1999

[54] ENGINE CYLINDER HEAD COOLING ARRANGEMENT

[75] Inventor: Masahiko Iikura, Iwata, Japan

[73] Assignee: Yamaha Hatsudoki Kabushiki Kaisha, Iwata, Japan

[21] Appl. No.: 268,509

[22] Filed: Jun. 30, 1994

[30] Foreign Application Priority Data

Jun. 30, 1993 [JP] Japan ..... 5-162578

[51] Int. Cl.[6] ..... F02F 1/36

[52] U.S. Cl. ..... 123/41.82 R

[58] Field of Search ..... 123/41.76, 41.77, 123/41.82 R, 315, 432

[56] References Cited

U.S. PATENT DOCUMENTS 2,707,944 5/1955 Brantingham ..... 123/41.77

5,222,464 6/1993 Oyaizu ..... 123/41.82 R

*Primary Examiner*—Noah P. Kamen

*Attorney, Agent, or Firm*—Knobbe, Martens, Olson & Bear

[57] ABSTRACT

A cylinder head arrangement for a multiple valve internal combustion engine including an arrangement for cooling the flow passages and also the valve guides which extends longitudinally of the cylinder head so as to promote cooling and the extraction of vapor and air from the engine cooling jacket.

19 Claims, 5 Drawing Sheets

ENGINE CYLINDER HEAD COOLING ARRANGEMENT

BACKGROUND OF THE INVENTION

This invention relates to an internal combustion engine and more particularly to an improved cooling arrangement for the cylinder head of such engine.

In overhead valve engines, the intake and/or exhaust passages are formed directly in the cylinder head. Where the engine or cylinder head is liquid cooled, the cylinder head is formed with an internal cooling jacket and the intake and/or exhaust passages are formed by internal walls in the cylinder head around which the cooling jacket extends. However, there are portions of the wall that define the passages which may have larger wall thicknesses, for example, in the area where the valve stems are supported. These thicker wall sections reduce the amount of cooling that is possible for the flow passage.

Where multiple passages are employed for either the intake and/or the exhaust function, it is generally the practice to have the passages formed by a common wall. These common walls provide a substantially greater thickness and thus provide a mass in the interior of the cylinder head which may not be adequately cooled.

In addition, these complex type of internal walls can give rise to pockets where pockets may form, such as either water vapor and/or air, and the cooling of the cylinder head is further deteriorated.

It is, therefore, a principle object of this invention to provide an improved cylinder head cooling arrangement wherein the cooling of the passages in the cylinder head is ensured.

It is a further object of this invention to provide an improved cylinder head arrangement for an internal combustion engine wherein the wall forming the flow passage of the cylinder head is formed with a coolant passage for permitting not only coolant flow but for purging air or water vapor from the cooling jacket and avoiding the formation of pockets that are not filled with liquid coolant.

SUMMARY OF THE INVENTION

This invention is adapted to be embodied in a cylinder head cooling arrangement for an overhead valve internal combustion engine that comprises a cylinder head which has a lower surface that is adapted to be sealingly engaged with a cylinder block around a cylinder bore. The cylinder head lower surface has a portion that cooperates with the cylinder bore to form a combustion chamber. At least one valve seat is formed on one side of the cylinder head lower surface portion at one end of a gas flow passage formed by an internal wall formed in one side of the cylinder head. A water jacket is formed in the cylinder head around, at least in part, the wall and flow passage, and the cylinder head lower surface portion. A coolant flow passage is formed in the internal wall and extends transversely to the gas flow passage for coolant flow through the wall.

DETAILED DESCRIPTION OF THE PREFERRED EMBODIMENT OF THE INVENTION

Figure 1:
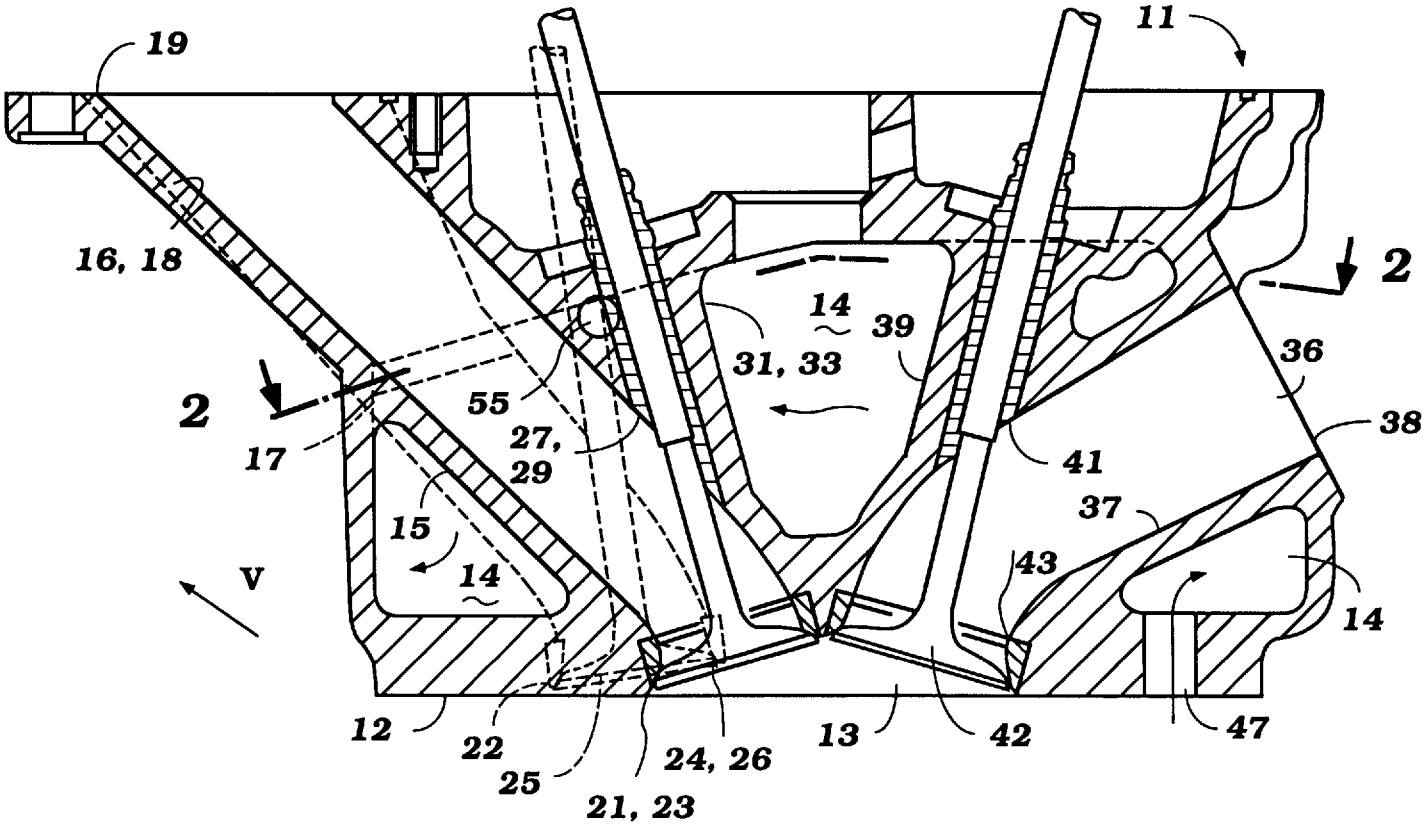
FIG. 1 is a cross-sectional view of a cylinder head of an internal combustion engine constructed in accordance with an embodiment of the invention and is taken generally along the line 1—1 of FIG. 2.
Figure 2:
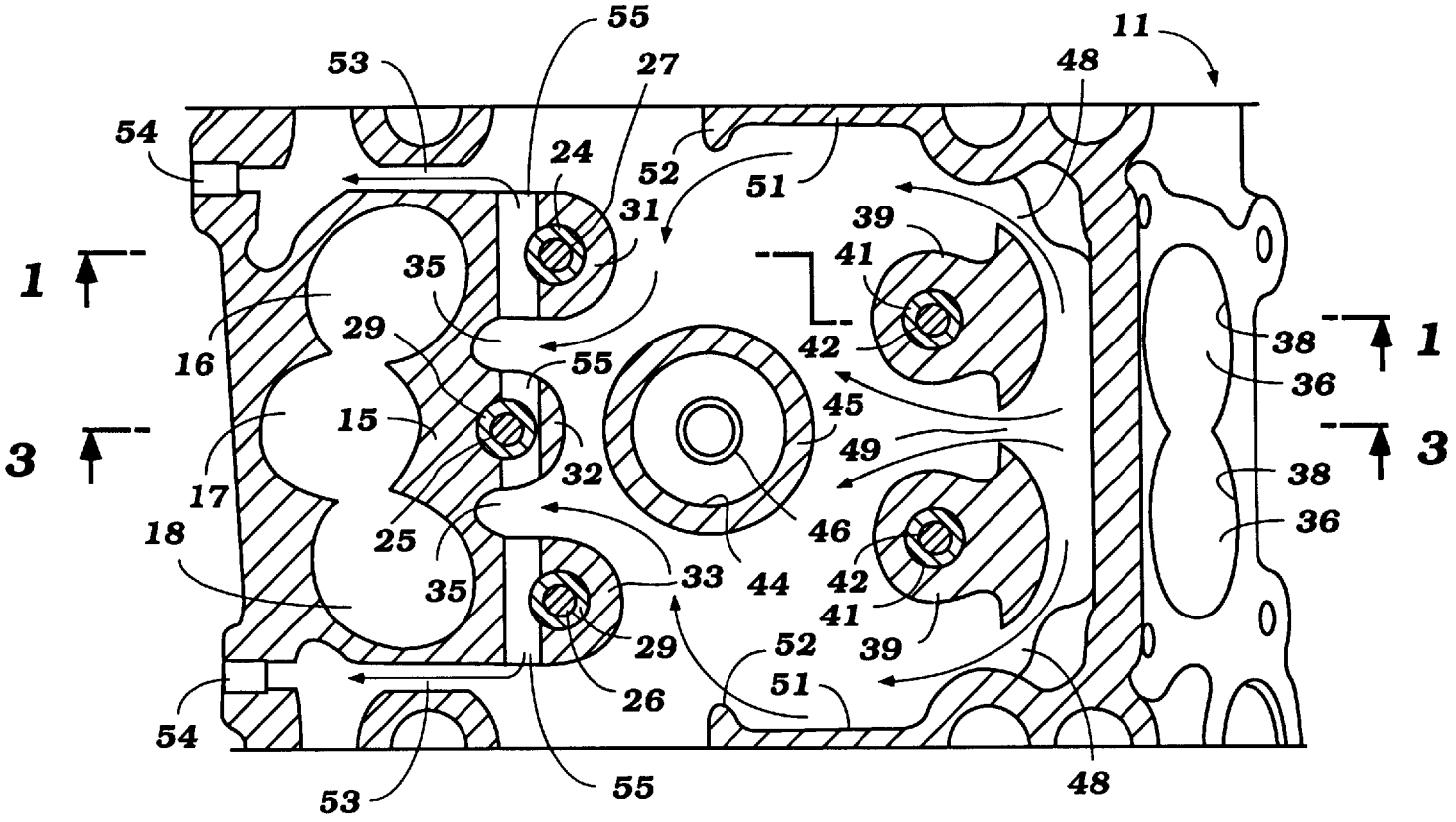
FIG. 2 is a cross-sectional view taken along the line 2—2 of FIG. 1.
Figure 3:
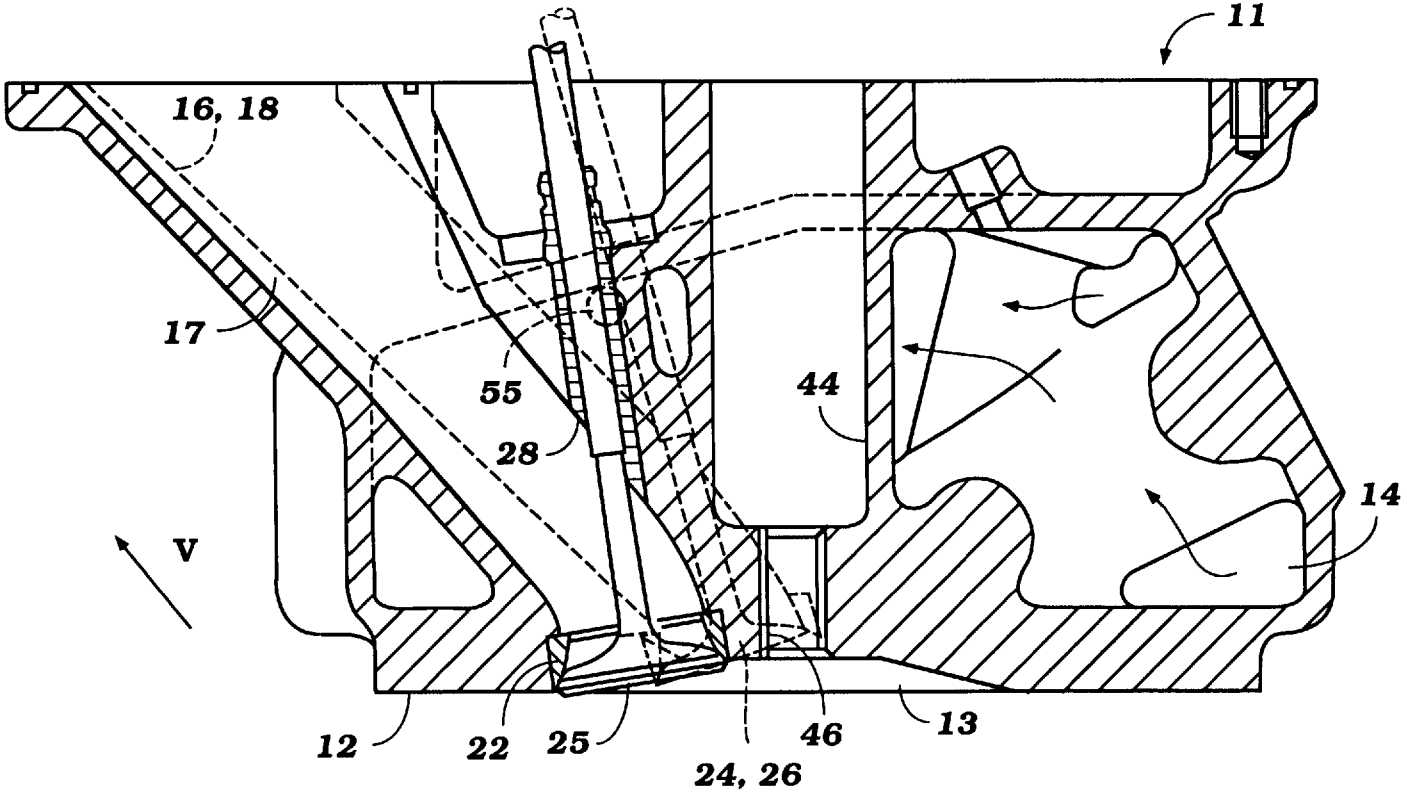
FIG. 3 is a cross-sectional view taken along the line 3—3 of FIG. 2.

Referring now in detail to the drawings and initially to FIGS. 1–3, a cylinder head for use with an internal combustion engine is shown partially and is identified generally by the reference numeral 11. The cylinder head 11 is illustrated only in relation to the area which encloses a single cylinder bore of the associated cylinder block. It should be readily apparent to those skilled in the art how the invention is employed in conjunction with multiple cylinder engines. In addition, in the illustrated embodiment, the cylinder head 11 is the cylinder head for one bank of a V-type engine. Although the invention is described in conjunction with V-type engines, where it has particular utility, it should be readily apparent to those skilled in the art how the invention may be employed with engines having other cylinder orientations.

The cylinder head 11 is formed as a casting from a lightweight material, such as an aluminum or aluminum alloy. It has a lower surface 12 which, as has been noted, is adapted to be affixed in sealing relationship with the upper end of the appropriate bank of the cylinder block. This lower surface 12 is provided with a central recessed area 13 which forms, in part, the combustion chamber of the engine. This combustion chamber is completed by the cylinder bore and piston which reciprocates therein.

The cylinder head 12 is water or liquid cooled and is formed with an internal cooling jacket 14 to which liquid coolant is delivered in a manner to be described. An intake passage arrangement is formed in one side of the cylinder head casting 11 by means of an internal wall, indicated generally by the reference numeral 15, which is surrounded substantially by the cooling jacket 14. In the illustrated embodiment, the wall 15 forms three siamesed intake passages 16, 17 and 18 which extend from an inlet opening 19 formed in an upper surface of the cylinder head 11. Although the invention is described in conjunction with a siamese type of intake passage, it should be readily apparent that the invention may be employed with engines having individual intake passages. However, with the use of multiple valve arrangements, it is more common to provide siamesed passages because of the spacial requirements of the head assembly.

Each of the intake passages 16, 17 and 18, however, terminates at a respective valve seat 21, 22 and 23, which extend into the combustion chamber recess 13 so as to deliver a charge to the combustion chamber of the engine. Poppet type intake valves 24, 25 and 26 are slidably supported in respective valve guides 27, 28 and 29 that are pressed or cast into the cylinder head 11 in any well known manner. The wall 15 is formed with individual protuberances 31, 32 and 33 which extend inwardly to the cooling jacket 14 from the passages 16, 17 and 18 so as to afford adequate support for the valve guides 27, 28 and 29. These projections 31, 32 and 33 are formed with recesses 34 and 35 between them, as clearly shown in FIG. 2.

Any suitable mechanism is provided for operating the poppet valves 24, 25 and 26 and reference may be had to U.S. Pat. No. 4,660,529, entitled "Four Cycle Engine", issued in the name of Masaaki Yoshikawa, and assigned to the assignee hereof, for any of a wide variety of types of arrangements that may be employed for opening and closing the valves 24, 25 and 26. As disclosed in that patent, the intake valves 24 and 26 have their reciprocal axes disposed about in a common plane that is disposed at an acute angle to a longitudinal plane containing the axis of the associated cylinder bore. The poppet valve 25 reciprocates about an axis that is inclined to this plane and to the plane of reciprocation of the poppet valves 24 and 26. The acute angle to the plane containing the axis of the cylinder bore is less than that of the poppet valves 24 and 26, as described therein.

On the side of the cylinder head opposite the intake passages 16, 17 and 18, there are formed a pair of exhaust passages 36 which are formed by respective internal walls 37, which are encircled by the cooling jacket 14. The exhaust passages 36 are generally not siamesed, except that their outlet openings 38 in the outer surface of the cylinder head 11 do overlap each other.

The internal walls 37 have protuberances 39 that receive valve guides 41 for supporting exhaust valves 42 for reciprocation in the cylinder head 11. The exhaust valves 42 cooperate with exhaust valve seats 43 formed in the cylinder head recessed portion 13 in a known manner. Like the intake valves 24, 25 and 26, the exhaust valves 42 are oriented as described in U.S. Pat. No. 4,660,529. That is, the exhaust valves 42 reciprocate about reciprocal axes that lie at a common plane that is at an acute angle to the aforenoted plane containing the axis of the associated cylinder bore. This acute angle is between the acute angles of the reciprocal axes of the intake valves 25 and 24 and 26.

A spark plug well 44 is formed by a generally cylindrical wall 45 of the cylinder head which is disposed centrally of the cylinder bore axis and which terminates at a tapped hole 46 at its lower end so as to receive a spark plug that has its gap disposed substantially centrally in the combustion chamber for each cylinder.

The construction as thus far described may be considered to be conventional and, for that reason, further description of it is not believed to be necessary to enable those skilled in the art to practice the invention.

As has been noted, the cylinder head cooling jacket 14 has coolant delivered to it, and the way this is done will now be described by continuing reference to FIGS. 1–3. There are provided a plurality of coolant inlet passages 47 that extend through the cylinder head lower surface 12 and which cooperate with coolant passages formed in the upper end of the cylinder block for receiving coolant from the cylinder block cooling jacket and delivering it to the cylinder head cooling jacket 14. This coolant flows on the underside of the exhaust passages 36 and around them toward the intake side of the engine through a pair of passages 48 that are formed on the outer side of the walls 37 and a central passage 49 that is formed between the wall portions 39 so that the coolant will flow from the exhaust side, around the spark plug well 44 to the intake side. It should be noted that the area bounding each side of each cylinder of the engine is provided with an internal wall 51 which terminates in an inwardly extending projection 52 adjacent the spark plug well 44 so as to cause the coolant flow, shown by the arrows in the figures, to be directed inwardly toward the spark plug well 44 and to the area where the intake passage forming wall 15 has the recesses 34 and 35.

A pair of drilled passages 53 are formed that extend transversely through the outer periphery of the wall 15 outside of the intake passages 16 and 18 and which may be drilled through the intake side of the engine through counterbores 54 which are subsequently closed by closure plugs. This permits the coolant to flow to a portion of the cooling jacket 14 under the intake passages 16, 17 and 18 where it may be discharged back to the cooling system through a suitable return passage.

In order to permit adequate cooling air flow and and/or vapor discharge, a drilled passageway 55 is drilled longitudinally of the cylinder head from one end to the other and which intersects the wall protuberances 31, 32 and 33 and which will also intersect the openings in which the valve guides 27, 28 and 29 are formed. Because of the staggering of the intake valve axes, the drilled passage 55 extends to the left of the valve guides 27 and 29 and to the right of the valve guide 28, as clearly shown in FIG. 2. Because of the provision of this drilled passage 55, coolant may flow to the recessed areas 34 and 35 and then be, in part, redirected to flow through the drilled passages 55 and into the passages 53 for discharge from the cylinder head 11, as aforenoted.

In addition, the drilled passage 55 is formed at the upper end of the cooling jacket 14. Because the cylinder head is disposed on the inclined upper surface of the cylinder block, a vertical line, as indicated at V in FIGS. 1 and 3, indicates the normal direction the cylinder head is mounted. Hence, because of the high location of the drilled passageway 55, any vapor which may be formed in the cooling jacket 14 or any air which may enter will be flushed through the drilled passage 55 and into the coolant flow for separation purposes. Hence, the arrangement is very effective in providing adequate cooling and also purging of any vapor or air from the cylinder head cooling jacket 14.

It should also be noted that when the valve guides 27, 28 and 29 are inserted into the cylinder head, this being done after the passage 55 is drilled, portions of the valve guides 27, 28 and 29 will also be directly contacted by the coolant so as to improve cooling of the valves and valve guides.

Figure 4:
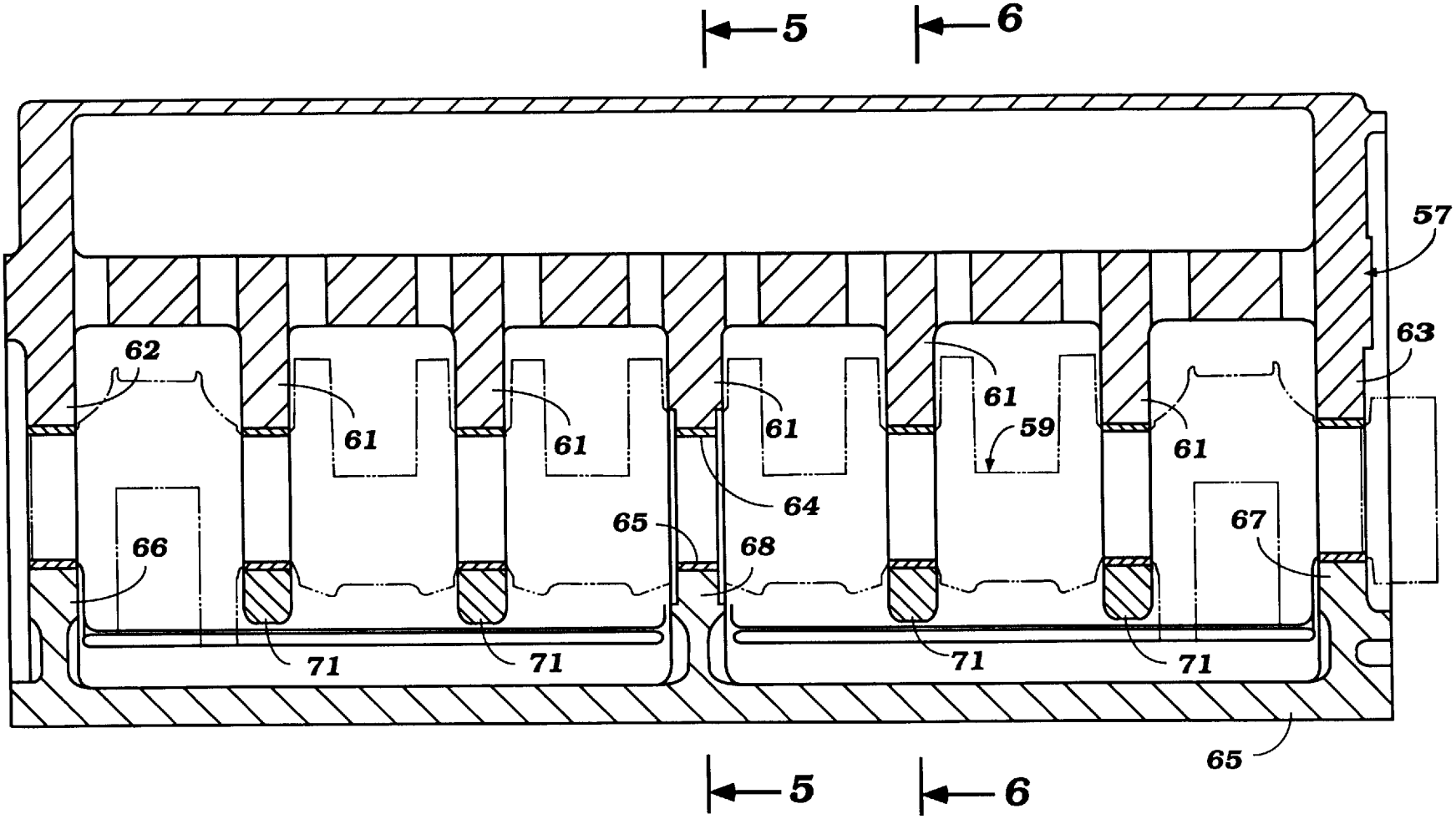
FIG. 4 is a cross-sectional view taken through the crankcase of the engine and generally passes through the plane of the axis of rotation of the crankshaft, which is shown in phantom in this figure.
Figure 5:
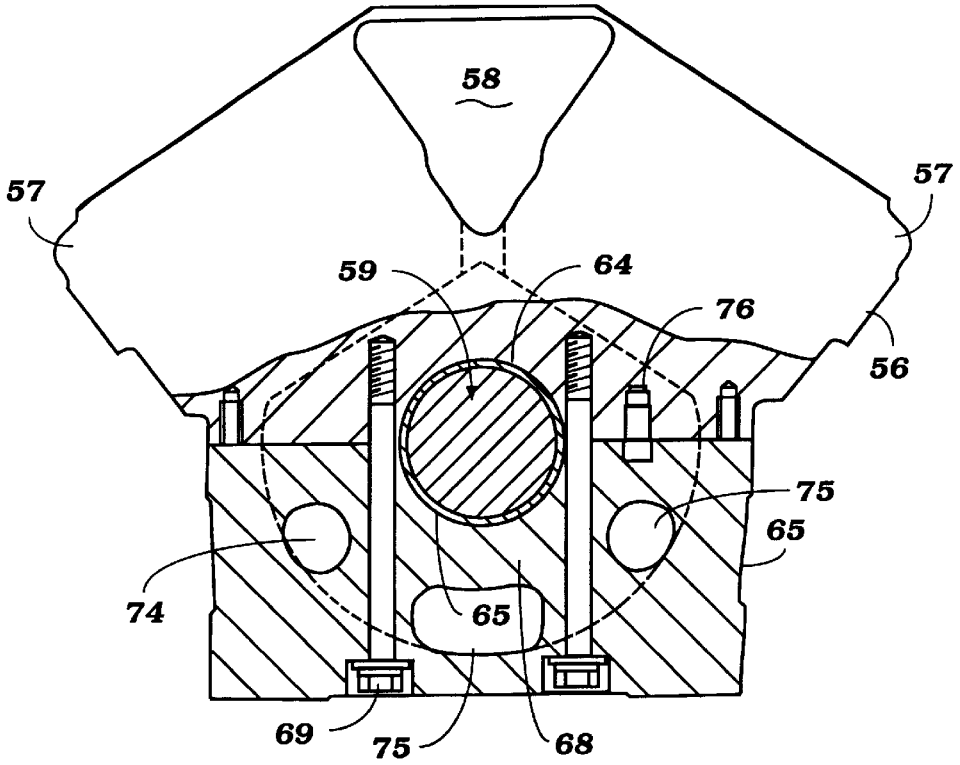
FIG. 5 is a cross-sectional view taken along the line 5—5 of FIG. 4.
Figure 6:
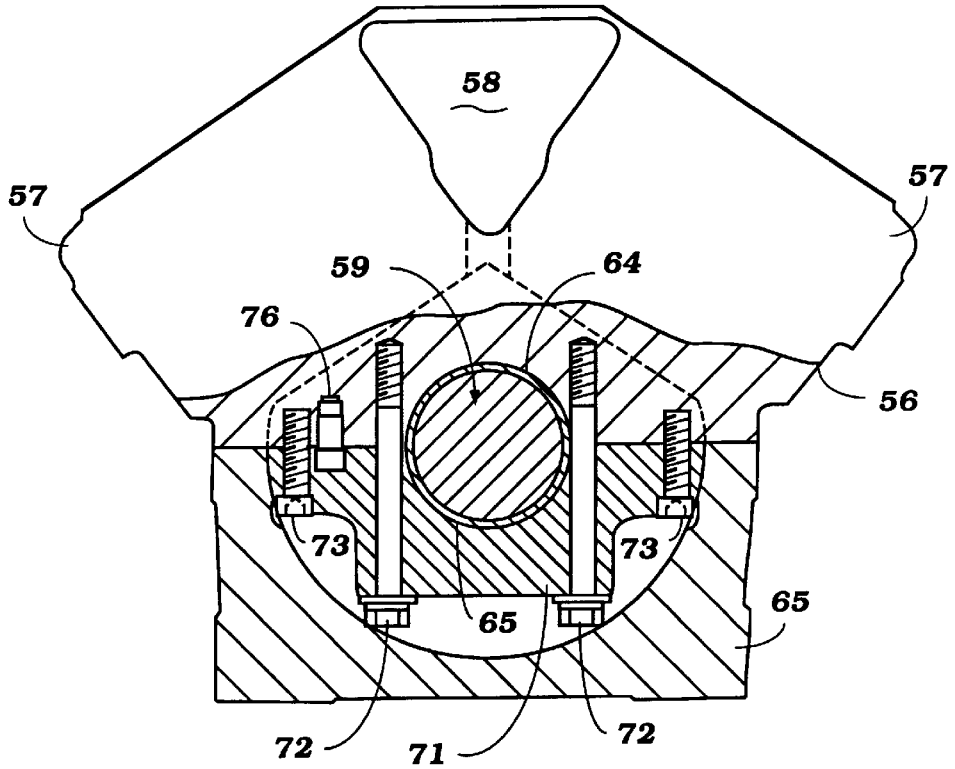
FIG. 6 is a cross-sectional view taken along the line 6—6 of FIG. 4.

It has been noted that the cylinder heads 11 are affixed to the respective banks of a cylinder block, and this construction in the crankshaft of the engine and bearing arrangement therefor are illustrated in FIGS. 4–6, which will now be described in detail.

In these figures, the cylinder block is indicated generally by the reference numeral 56, and it will be seen that it has a pair of inclined cylinder banks 57 which define a valley 58 therebetween. The cylinder bores for the engine are formed suitably in the cylinder banks 57 in any known manner. In the illustrated embodiment, the engine is of the V-12 type, and hence each cylinder bank 57 is provided with 6 cylinder bores.

The engine crankshaft is shown in phantom lines in FIG. 4 and in solid lines in FIGS. 5 and 6, and is identified generally by the reference numeral 59. This crankshaft 59 is journalled within intermediate walls 61 of the cylinder block 56 and end walls 62 and 63 by means of bearing inserts 64.

A crankcase member 65, which may be formed from a light alloy casting or the like, is provided with a pair of end walls 66 and 67 which form the remaining bearing halves of the end bearings provided by the cylinder block walls 62 and 63 and a center wall 68 that cooperates with the center internal wall 61 of the cylinder block 57. Suitable bearing inserts 65 are provided in these walls and cooperate with the bearing inserts 64. A plurality of threaded fasteners 69 affix the crankcase member 65 to the cylinder block 57.

The remaining intermediate bearings of the crankshaft 59 are journalled by the walls 61 of the cylinder block 57 as aforenoted and by individual bearing caps 71 that are affixed to the cylinder block walls 61 by respective threaded fastener 72 (FIG. 6). In addition, further threaded fasteners 73 assist in affixing the bearing cap 71 to the cylinder block 57.

The center wall 68 of the crankcase member 65 is provided with through openings 74 and 75 so that lubricant may flow through the crankcase chamber. A plurality of locating pins 76 may also be inserted in bores in the cylinder block 57, crankcase member 65 and bearing cap 71 for locating purposes.

It should be readily apparent from the foregoing description that the described cylinder head arrangement provides very good cooling and vapor and air extraction from the cooling jacket, even though the cylinder head is provided with a large flow passage area. In addition, the valve guides and valve stems are also adequately cooled. Of course, the foregoing description is that of a preferred embodiment of the invention, and various changes and modifications may be made without departing from the spirit and scope of the invention, as defined by the appended claims.

I claim:

1. A cylinder head cooling arrangement for an overhead valve internal combustion engine comprising a cylinder head having end faces and a lower surface extending between said end faces and adapted to be sealingly engaged with a cylinder block around a cylinder bore, said cylinder head lower surface having a portion cooperating with the cylinder bore to form a combustion chamber, at least one valve seat on one side of said cylinder head lower surface portion at one end of a gas flow passage formed by an internal wall formed in one side of said cylinder head and defining a gas flow path extending in the area between said end faces and parallel thereto, a water jacket formed in said cylinder head at least in part around said wall and said gas flow passage and said cylinder head lower surface portion, and a coolant flow passage formed in said internal wall and extending transversely to said end faces and said gas flow path passage for coolant flow through said wall.

2. The cylinder head cooling arrangement as set forth in claim 1, wherein the wall is further provided with a protuberance for receiving a valve guide for reciprocally supporting a valve for controlling the flow through the valve seat and wherein said coolant flow passage is formed in said protuberance.

3. The cylinder head cooling arrangement as set forth in claim 2, wherein the coolant flow passage extends contiguous to the valve guide.

4. The cylinder head cooling arrangement as set forth in claim 3, wherein the valve guide is formed as a separate insert into the cylinder head and the coolant flow passage intersects said valve guide.

5. The cylinder head cooling arrangement as set forth in claim 1, wherein the wall defines at least two gas flow passages, each extending from a respective valve seat.

6. The cylinder head cooling arrangement as set forth in claim 5, wherein the wall is provided with a plurality of protuberances, one for each passage, and each of which slidably supports the stem of a poppet valve, a coolant flow passage being formed in each protuberance.

7. The cylinder head cooling arrangement as set forth in claim 6, wherein the coolant flow passage extends contiguous to the valve guides.

8. The cylinder head cooling arrangement as set forth in claim 7, wherein the valve guides define reciprocal axes for the valves that are disposed at different acute angles to a plane containing the axis of the associated cylinder bore.

9. The cylinder head cooling arrangement as set forth in claim 8, wherein the wall protuberances receive inserted valve guides and wherein the coolant flow passage for one protuberance passes between the valve guide and the respective gas flow passage and the other protuberance on opposite side of the respective valve guides.

10. The cylinder head cooling arrangement as set forth in claim 9, wherein the wall defines three flow passages, each terminating at a respective valve seat, and wherein two of the valves reciprocate about axes that lie in a common plane, and the remaining valve reciprocates about a plane that extends at an angle to the common plane.

11. The cylinder head cooling arrangement as set forth in claim 6, wherein the protuberances define a recess therebetween and wherein the cooling jacket is configured so as to direct coolant flow to the recess, and wherein the coolant flow passages each intersect the recess.

12. The cylinder head cooling arrangement as set forth in claim 11, wherein there are three gas flow passages formed by the wall and there are three protuberances, one for each passage.

13. The cylinder head cooling arrangement as set forth in claim 12, wherein there are provided recesses between each pair of protuberances.

14. The cylinder head cooling arrangement as set forth in claim 13, wherein the coolant flow passages extend contiguous to the valve guides.

15. The cylinder head cooling arrangement as set forth in claim 14, wherein the valve guides define reciprocal axes for the valves that are disposed at different acute angles to a plane containing the axis of the associated cylinder bore.

16. The cylinder head cooling arrangement as set forth in claim 15, wherein the wall protuberances receive inserted valve guides and wherein the respective coolant flow passage intersects the respective valve guides on opposite sides of the respective valve guides from one end face to the other.

17. The cylinder head cooling arrangement as set forth in claim 16, wherein the wall defines three flow passages, each terminating at a respective valve seat, and wherein two of the valves reciprocate about axes that lie in a common plane, and the remaining valve reciprocates about a plane that extends at an angle to the common plane.

18. The cylinder head cooling arrangement as set forth in claim 17, wherein there are formed on the other side of the cylinder head two additional gas flow passages.

19. The cylinder head cooling arrangement as set forth in claim 18, wherein the two other gas flow passages are each formed by a separate internal wall of the cylinder head and each surrounded by the cooling jacket.

* * * * *